United States Patent [19]

Sansone et al.

[11] Patent Number: 5,008,827

[45] Date of Patent: Apr. 16, 1991

[54] CENTRAL POSTAGE DATA COMMUNICATION NETWORK

[75] Inventors: Ronald P. Sansone, Weston; Karl H. Schumacher, Westport, both of Conn.; Raymond Keating, Purdys, N.Y.; Joseph W. Wall, Monroe; Uday W. Joshi, Wilton, both of Conn.

[73] Assignee: Pitney Bowes Inc., Stamford, Conn.

[21] Appl. No.: 285,891

[22] Filed: Dec. 16, 1988

[51] Int. Cl.[5] ..... G07B 17/00

[52] U.S. Cl. ..... 364/464.02

[58] Field of Search ..... 364/464.02, 464.03, 364/466

[56] References Cited

U.S. PATENT DOCUMENTS

| | | | |
|---|---|---|---|
| 4,097,923 | 6/1978 | Eckert, Jr. et al. | 364/900 |
| 4,122,532 | 10/1978 | Dlugos et al. | 364/900 |
| 4,511,793 | 4/1985 | Racanelli | 364/466 X |
| 4,649,266 | 3/1987 | Eckert | 364/464.02 X |
| 4,713,761 | 12/1987 | Sharpe et al. | 364/406 |
| 4,752,950 | 6/1988 | Le Carpentier | 364/464.02 X |
| 4,800,504 | 1/1989 | Durst, Jr. et al. | 364/464.02 X |
| 4,800,505 | 1/1989 | Axelrod et al. | 364/464.03 X |
| 4,812,965 | 3/1989 | Taylor | 364/550 |
| 4,813,912 | 3/1989 | Chickneas et al. | 364/464.02 |
| 4,831,555 | 5/1989 | Sansone et al. | 364/464.02 X |
| 4,852,013 | 7/1989 | Durst, Jr. et al. | 364/464.02 X |

OTHER PUBLICATIONS

"Shiptrac'r Applications" by Vocam Systems Inc., Bloomington, Minnesota; copyright 1988.

*Primary Examiner*—Parshotam S. Lall
*Assistant Examiner*—Edward R. Cosimano
*Attorney, Agent, or Firm*—Peter Vrahotes; Melvin J. Scolnick; David E. Pitchenik

[57] ABSTRACT

A communication system for processing information for distribution, including: a central data station, a plurality of user stations, each of the user stations including a plurality of components forming a secure path for the proper distribution of the information, a communication link interconnecting the user stations with the central data stations, the central data station including means for periodically interrogating a user station for determining the operational status of each of the components, means located within the central data station for indicating an error condition in any one of the components, and means at the central data station for transmitting a condition signal from the central data station to the user station for indicating the error condition.

68 Claims, 10 Drawing Sheets

CENTRAL POSTAGE DATA COMMUNICATION NETWORK

BACKGROUND OF THE INVENTION

This invention relates to mail processing, and specifically to improvements in mail processing systems, which will relieve central postage facilities of certain mail handling tasks.

The U.S. currently has the world's largest postal system. The U.S. Post Offices currently handle in excess of 100 billion pieces of mail per year, about half the total volume handled throughout the world. The servicing of mail delivery involves three essential steps; collection, sorting and delivery. Collection takes place through a series of post offices spread throughout the U.S. The U.S. has about 30,000 post offices that provide mail services in addition to 9,000 smaller postal centers which provide some kind of some type of mail service. Postal employees typically take letters and packages from mail box facilities to the nearest local office where it is accumulated for the sorting procedure. At the post office, postal clerks remove collected mail from sacks, bundle packages and segregate mail by size and class into separate categories. The mail travels by truck from local post offices to a central facility known as a sectional center. The U.S. has 264 sectional centers, some of which serve hundreds of local post offices. The sectional center processes nearly all the mail coming or going from its region. At the sectional center, high speed automated equipment sorts large volumes of mail. The postal service currently uses two sorting systems. One system is devoted to letters and other first class mail, and the other system, for bulk mailing is used to sort packages, magazines advertising, circulars and other large mails. The letter sorter process involves manually moving mail sacks onto moving conveyor belts, which carry the mail to a machine called an edger-feeder which sorts it according to envelope size. The postal service regulates the size of envelopes to make such mechanical sorting easier. The edger-feeder feeds the letters into another machine known as a facer-cancellor. Sensing devices of the facer-cancellor determine where the stamp is located on the envelope, and enable the machine to arrange the letters so that they all face in the same direction. The cancelling portion of the mechanism then cancels the stamp by printing black lines and the like over it so that it cannot be used again. The machine also prints a postmark on the envelope, including the date, the name of the sectional center, an abbreviation for the state and a three, four or five-number zip code. In addition, the postmark records the time period during which the letter wa received at the post office. A computerized machine known as a zip mail translator sorts the postmarked letters according to the their destination post office. Postal workers selectively activate the machine's keyboard to send each letter on a conveyor belt into one of hundreds of bins. Each bin holds mail for a different post office. Mail addressed to locations outside the regions served by the sectional center are transported by truck, airplane or train to other sectional centers for further sorting. Finally, postal clerks hand sort mail for the area served by the sectional center into bundles for each delivery route. The zip mail translators in some postal areas have been replaced by more advanced computerized machines called optical character readers which read the zip code on the letter, and pass the mail to another machine that places a series of marks known as bar codes onto the envelope. Additional mechanisms read the bar code and sort mail according to the regions indicated by said bar code. Mail addressed to locations within the regions served by the section center is sorted again by other bar code readers according to destination post office and then according to delivery route. An expanded nine-number zip code, chiefly for use by high-volume mailers, enables the post office to substantially reduce some of this essential time consuming and extensive sorting services. The same processes apply to sorting bulk mail. Current estimates indicate that the foregoing processing tasks necessarily involve in excess of half a million employees. Cost of maintaining and supporting sorting services at the central post office facilities, even including large scale use of automated equipment, has become staggering. Projections of substantial increases in volumes of mail being transporting through central facilities, even with the advent of private delivery, telecommunications services, facsimile services and the like indicate that a rapid expansion will be required of such facilities. Since the postal service is a private corporation and is expected to become self-supporting, rapidly advancing postal rates place greater and greater burdens on both users and the postal service in order to support such volumes of mail. In recognition of capabilities of certain high volume users to provide services to central postal facilities, which services may improve efficiency and reduce the amount of processing time required by the central serving facilities, the U.S. Postal Service offers substantial reductions in rates, provided that a user comply with certain requirements which will allow the U.S. Postal Service to take advantage of certain user-provided facilities to reduce its own work load. The concept of work sharing, wherein a user provides certain of the processing activities prior to delivering the mail to the central postal facilities has been proposed and is therefore a positive innovation in the field of mail processing which may have a substantial impact in the future implemention of mail services.

However, placing a burden on the user to provide certain of the facilities and services which the U.S. central post office facilities now provide is an equally heavy burden for the user, and must be done in a manner which permits the user to realize substantial savings with its own increased work load by taking advantage of the reduced postal service rates while not exceeding the reduction in rates by the serving costs of providing such services on its own.

The Postal Service has already recognized the ability of users to preprocess certain kinds of mail and will accept mail in bulk delivered from a processor along with certification that its procedures have been complied with, and will accept such certification as prima facia justification for reduction in postal service rates. Thus, for example, manifest systems, wherein a manifest is provided to the central post office representative of a group of documents preprocessed by the user, are already known and do allow the user to realize a substantial reduction in rate. One form of such a system is described in a commonly-assigned U.S. Pat. No. 4,837,701, filed Sept. 5, 1986 However, a large number of additional services, aside from manifesting services, may also be provided by the user and accepted as such by the central processing facility of the postal service in exchange for rate reductions. These additional services, however, require interface communications between the central service and the user so as to maintain within the user's facility information regarding internal postal procedures, such as rates, volume, quantity discounts and the like in order for the central post office facility to accept as valid a certification by the user that certain procedures mandated by the Postal Service have been complied with. The automation of such processing, through the use of telephone or other data communication links, is essential to the successful operation of such a system. The use of communication interfaces are known. However, the problems with maintaining integrity of such a system, allowing for maintenance, or the ability to locate mailpieces within a system, or the ability to train new users remains a serious limitation.

It is therefore the principal object of the present invention to provide a system and apparatus within a user facility which will both operate and maintain, in current fashion, certain preprocessing facilities which can be certified and accepted as properly performed via such certification by the central processing facilities of the U.S. Postal Service in order to qualify for substantial reductions in rate.

It is a further object of the present invention to provide a self-contained apparatus which will operate substantially without the intervention of human operators, to automate the internal processing facility at a user location while maintaining sufficiently proper standards with regard to U.S. Postal Service requirements so as to provide certification in a manner acceptable to postal authorities.

It is another object of the present invention to implement a user operated certification system with sufficient security consideration to satisfy the U.S. Postal Service of the integrity of a user operated service sharing facility.

It is a further object of the present invention to provide a system and apparatus within a user facility which will both operate and maintain, in current fashion, certain preprocessing facilities which can be certified and accepted as properly performed via such certification by the central processing facilities of the U.S. Postal Service in order to qualify for substantial reductions in rate by the use of bidirectional communication links, and in so doing to utilize the communication link to augment and update data base facilities at the user and base stations so that facilitation of user limited facilities may be expanded beyond the user capacity by interaction with the larger central station.

It is a further object of the present invention to provide a system and apparatus within a user facility which will utilize the communication facilities of the system employed herein to implement inspection services, diagnostic analysis and repair procedures.

It is a further object of the present invention to provide a system and apparatus within a user facility which will utilize an article certification as a code line through a communication link to track an individual piece of mail.

It is a further object of the present invention to provide a system and apparatus within a user facility which will enable a central facility to permit the transmission of graphic material for the purpose of inclusion within a postage metering application.

BRIEF DESCRIPTION OF THE PRIOR ART

Prior systems relating to work share features are discussed in copending Applications, Ser. Nos. 285,146 and 234,977 filed concurrently, and Aug. 23, 1988, respectively and assigned to the assignee of the present invention, and U.S. Pat. No. 4,713,761, also assigned to the assignee of the present invention. The applications relate to the concept of using certain limited user provided services but do not encompass the full range of work sharing and data sharing services concepts presented herein. The U.S. patent relates to accounting and billing and does not solve the problem of relieving the postal service of substantial service burdens in an effective manner. Prior art manifesting or passpost systems, while allowing some form of certification, are difficult to implement in small user situations and are also cumbersome in their requirement for an additional document to accompany the delivery of mail to the postal service.

BRIEF DESCRIPTION OF THE INVENTION

The present invention relates to a method and apparatus for work sharing including information sharing between participants as well as self-contained automated processing facilities relative to specific requirements set forth by the Postal Service along with certification of compliance with such requirements acceptable to the Postal Service.

Specific certification requirements include analysis by the user of mail composition, currently known as 3602 Information, in accordance with the specific form currently employed by the post office facilities for such information, such composition including weight, volume, classifications, carrier route information, zip code, appropriate bar code, designations, and rate. In addition, other services such as extended presort coding addressing, accuracy of presorts, classification of mailpiece type for machine readability, accuracy of weight and volume in accordance with predesignated discount rates set by the Postal Service in accordance with such factors, and ultimately payment and billing, are all facilities which may be incorporated within a user facility. Incorporation of such information within a user facility, coupled with intercommunication capability between such user facility and a central postal facility, gives certain additional advantages to both user and postal facility which are inherent in the nature of information processing. Thus, the user facility may keep track for accounting purposes of its mailing and other processing as well as funding and volume uses, while the Postal Service may employ intercommunication with many of these user units to forecast workloads, transportation requirements, the management of asset inventory, the creation of mailer profiles, and other information which may be employable to establish process controlling to better manage the U.S. Postal Service resources. In addition, by making certain requirements of the user equipment, the requirement of range of operation of the central service facility equipment may be substantially narrowed. Thus, common fonts may be provided through user equipment which will reduce the requirement of central service facilities to have multiple font capability in optical character recognition.

The advantages of a telephone telecommunication link existing into the user equipment may be of further assistance with regard to other specific service functions. Thus, for example, the manufacturer of the equipment may be able to maintain a central service facility linking itself to all of the field applications of user equipment. This would be an important characteristic of certification provided by the U.S. Postal Service since it would ensure conformity of operation of all the user equipment in accordance with U.S. Postal Service requirements, as well as ensuring conformity of rate and regulation requirements.

An essential element in certification by the Postal Service includes insurance by the manufacturer of the integrity of the scales and accounting systems as well as the metering and certification stamps of the user equipment. In current equipment, such as postage meters, it is sufficient for the user to periodically bring the postal meter to the Postal Service for inspection. In large scale equipment, such as is employed in accordance with the concept of the present invention, bringing equipment to the Postal Service for inspection would be impractical. It would similarly be impractical for the Postal Service to send an inspector to the user facility, in view of the ultimate number of such user facility equipment in place and in view of the costs to the Postal Service involved in such operations. However, since the concept of the invention includes a telephone link, it is a further object of the present invention to provide a link between equipment at the user location and the central station for automating such a procedure.

The system thus provides for the user having equipment herein described coupled to a data center by means of a telephone link. The data center interrogates the user system periodically to determine the status of the equipment. Information that can be obtained during the interrogations can include the usage rate and status of the various components and sub-components of the system. This information is utilized to generate a series of reports to the user considering the status of the equipment, the need for user maintenance and the need for Pitney Bowes service calls. The system enables the scheduling of the service calls by leaving a message on the equipment indicating that a service call had been scheduled at a particular time and even by a specific individual.

The two-way nature of the communication link established by virtue of the central station between the U.S. Postal Service and the local user is also capable of two-way transmission. Since the local user has placed a certification stamp onto the individual mailpiece, such certification having a unique identifying characteristic, it is possible for the user, utilizing this same certification identification, to check on the progress of a particular item of mail through the U.S. postal service system. Thus, by the utilization of encryption and bar or other coding on mail pieces, termed key line coding and provided by the local user facility, a database can be established identifying the location of various mailpieces at any particular line in the course of delivery from local sender location, through all central facility location, to local delivery. This information can be captured at several points of entry into the system. The capture points may include the mailer when the mailpiece or parcel is placed into the carrier service, the carrier service when the mailpiece or parcel is sorted, when the mailpiece or parcel is placed into its delivery channel, when it is received at a bulk mail station, when it is received at each sectional station, when it is received at each central station, and when it is placed into local delivery. In this way, key-line tracking of the mailpiece or parcel is utilized to identify the parcel and by so doing with suitable encryption provides the mechanism to identify its location in the system.

Finally, the present invention allows the central station to provide communication facilities from the U.S. Postal Service to each of the remote user locations, in package form, which will enable the remote user locations to train employees to become aware of new techniques in mailing, new rates, new types of services and other means or modes by which the local user may take advantage of the presorting capability for additional rate discounts within his own piece of user equipment. The training packages may be downloaded from the central data station to the local user and may train current employees on new techniques by self-instruction in an interactive mode with the terminal itself. Additionally, new employees may be trained by utilizing the interactive training downloaded in the same manner. The training service is also available to the central station sales and customer representatives to train them and enhance their own abilities to sell equipment to local users. The system also enables downloading the third party advertising, which allow a customer to either provide third party advertising, thereby discounting the cost of its own mailing, or to download interesting graphics or other type of advertising for a particular mailing.

The maintenance of a two-way communication link between the central station and each of the user facilities permits the central station to keep a permanent record, available for inspection by the U.S. Postal Service, and which may be employed to confirm uses of any of the local users by cross-check of each of the elements of data which will be considered essential to any specific user application. Thus, each of the user applications is also designed to apply postage. Central accounting and data facilities may be employed to keep track of each user's postage requirements. The communicating link may also facilitate two-way charging and recharging of local postage meters from the central station, also under authority from the U.S. Postal Service, and as have been previously disclosed in prior art remote recharging systems currently in use. Thus, during the on-line periods, multiple quantities of data may be exchanged between the central station and the local user. Thus, the present invention also provides in one embodiment for the employment of a central station with multiple processing ability, capable of high speed data interchange between pluralities of remote local units and itself, and possessing the further capability internally of correlating data culled from each of the remote users which may be employed both for statistical purposes and for the purposes of moderating usage by each of the local users and for insuring compliance with the latest U.S. Postal Service rules, regulations and certification procedures for work sharing.

Communication in contrast may also be by means of a code or other form with the relevant information transmitted in encrypted format. The information may be scanned and used to automatically set the postal equipment at the user site to proper settings, both for postage and for usage scheduling, without direct user intervention, thus enhancing security and efficiency.

DESCRIPTION OF THE DRAWINGS

The foregoing brief description and summary of the invention will become more apparent from the following more detailed description of the invention, accompanied by the attached figures, wherein:

With reference to FIG. 1, a plurality of user stations designated as $U_1$, $U_2$. . . $U_n$, and identified as 10, 12 and 14 are shown. It will be understood that multiple user stations are possible in excess of the three shown, and that these are shown by way of example only. These stations are coupled by means of an interconnection network, illustrated generally at 16, to the data center 18, which in turn may be appropriately coupled by means of a secure line or the like to the U.S. Postal Service 20. The data center is a facility run by a commercial operation, such as Pitney Bowes, Inc., the assignee of the present invention. Each of the blocks 10, 12, 14, 18 and 20 contemplate the use of data processing components, each appropriately interlinked by means of high speed telecommunication links or the like for the purposes of exchanging information. It is also contemplated within the scope of the invention that the U.S. Postal Service will maintain an appropriate computer facility, not otherwise described herein, which will possess the capability of uploading and downloading specific pieces of information upon request by the data center, and relating to appropriate postal rules and regulations which will effect the use of certain discounts in mailing postal rates, as well as other factors necessary for the concept of shared work services which will be certified by each of the individual user stations in order to qualify for reduced rate requirements when mail is received in the U.S. Postal Service facilities. The communication link is also contemplated as a two-way link between units 18 and 20, wherein the U.S. Postal Service will have the capability of monitoring specific operations within the data center in order to ensure that the data center is operational in accordance with rules and requirements which may be imposed by the Postal Service from time to time. The monitoring operation is a periodic unscheduled communication link examination of certain storage areas of accessed memory locations for confirming proper operations. Of course, visual on site inspections and examinations may also be made.

With reference to FIG. 2, a more detailed functional component relationship of the data center is illustrated. Thus, the data center includes a first data channel 30 which includes a CPU 32 having a program memory 34, a keyboard 36 and an appropriate display 38 coupled thereto. Data communication link 40 interconnects CPU 32 to the U.S. Postal Service 20. Another data communication link 56 interconnects CPU 32 to CPU 46. The user units 10 are coupled via appropriate telecommunication data links 42 to a second data channel 44 which includes a CPU 46, a program memory 48, a keyboard 50 and an appropriate display 52. The CPU 46 is coupled to the data links 42 by means of a multi-channel I/O device 54 capable of high speed data communication.

Figure 1:
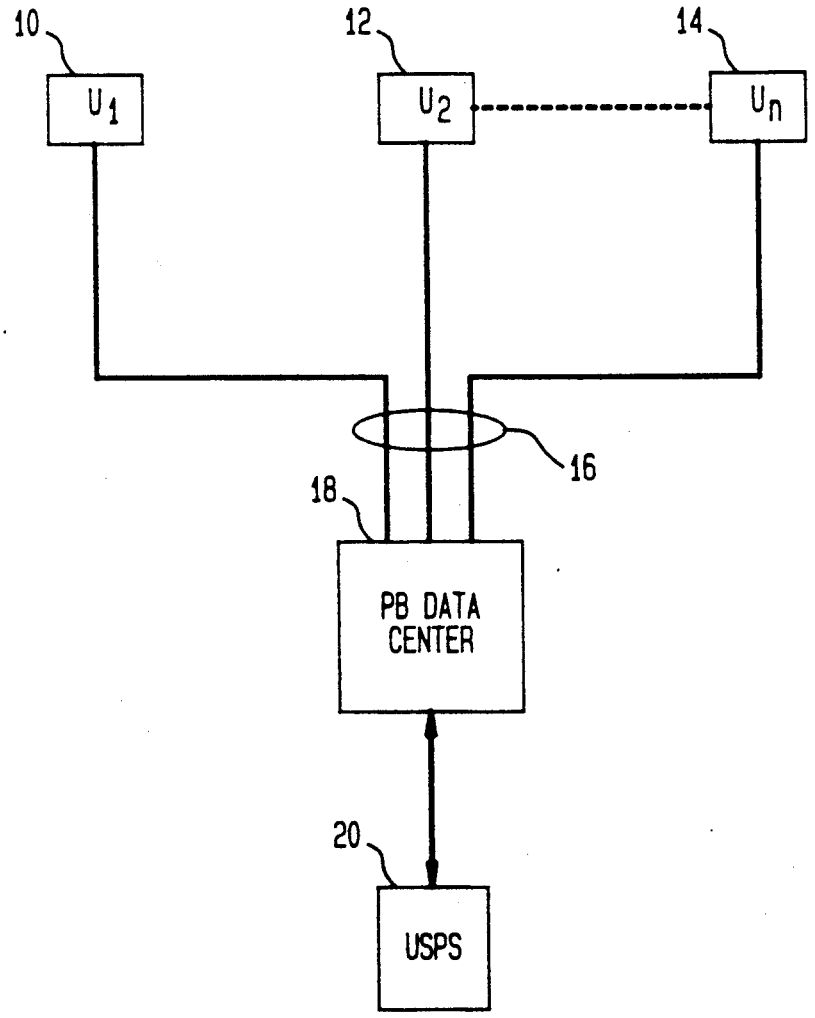
FIG. 1 is a functional block diagram illustrating the relationship between the data center, the U.S. Postal Service, and the local users.

In operation, two-way communication between the data channel 30 and the U.S. Postal Service 20 provide a continuous interchange of information regarding updates of U.S. Postal Service rules and regulations required for the continuous certification use by the local users 10. In addition, the data channel 30 may also be manually interrogated by means of keyboard 36 for inquiring of the Postal Service for specific information which may be employed with regard to compliance with certifications, the answering of specific data questions, or other uses requiring specific interrogation by means of the central station to the U.S. Postal Service. Since the U.S. Postal Service link is a two-way communication over channel line 40, it is possible through this link for the U.S. Postal Service to interrogate and monitor the operation of the first data channel 30 and the second data channel 44, for compliance with quality control and other security compliances which may be required by the U.S. Postal Service.

Turning now to the second data channel 44, high speed continuous two-way communication with respect to continuous update of U.S. Postal Service requirements for certification, servicing and diagnostics, training, and other information interchange, are effected by means of the CPU 46 operating through the high speed data channel 54 interfaced along with communication lines 42 to the multiple user network U1, U2 . . . Un. Operating under control of the program memory 48, the CPU 44 is contemplated as a high speed multiple processing information apparatus of conventional design such an IBM 3083 or a DCVAX unit which may handle multiple requests from any one or more, of the users simultaneously through the multiple channel I/O device. Keyboard 50 and display 52 may be utilized for manual information interchange between any of the local users and the information operator. Although only a single keyboard display unit is illustrated, it will be understood that dataline 58 is a schematic representation of the existence of a multiple number of display keyboard combinations evidencing the use at the central station of a plurality of key operators available to answer user questions upon interrogation.

Figure 2:
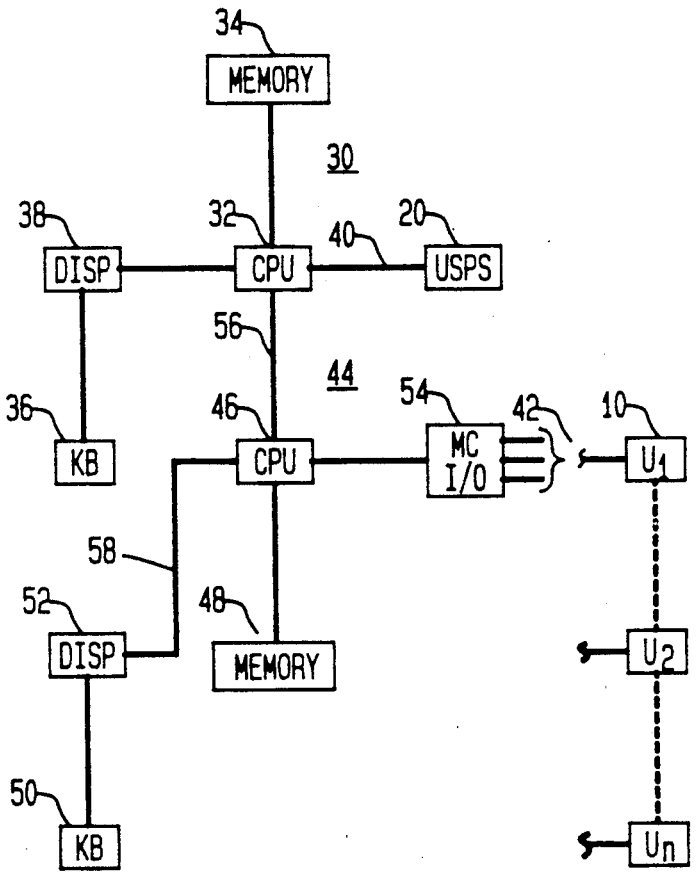
FIG. 2 is a more detailed block diagram illustrating a data center.
Figure 3A:
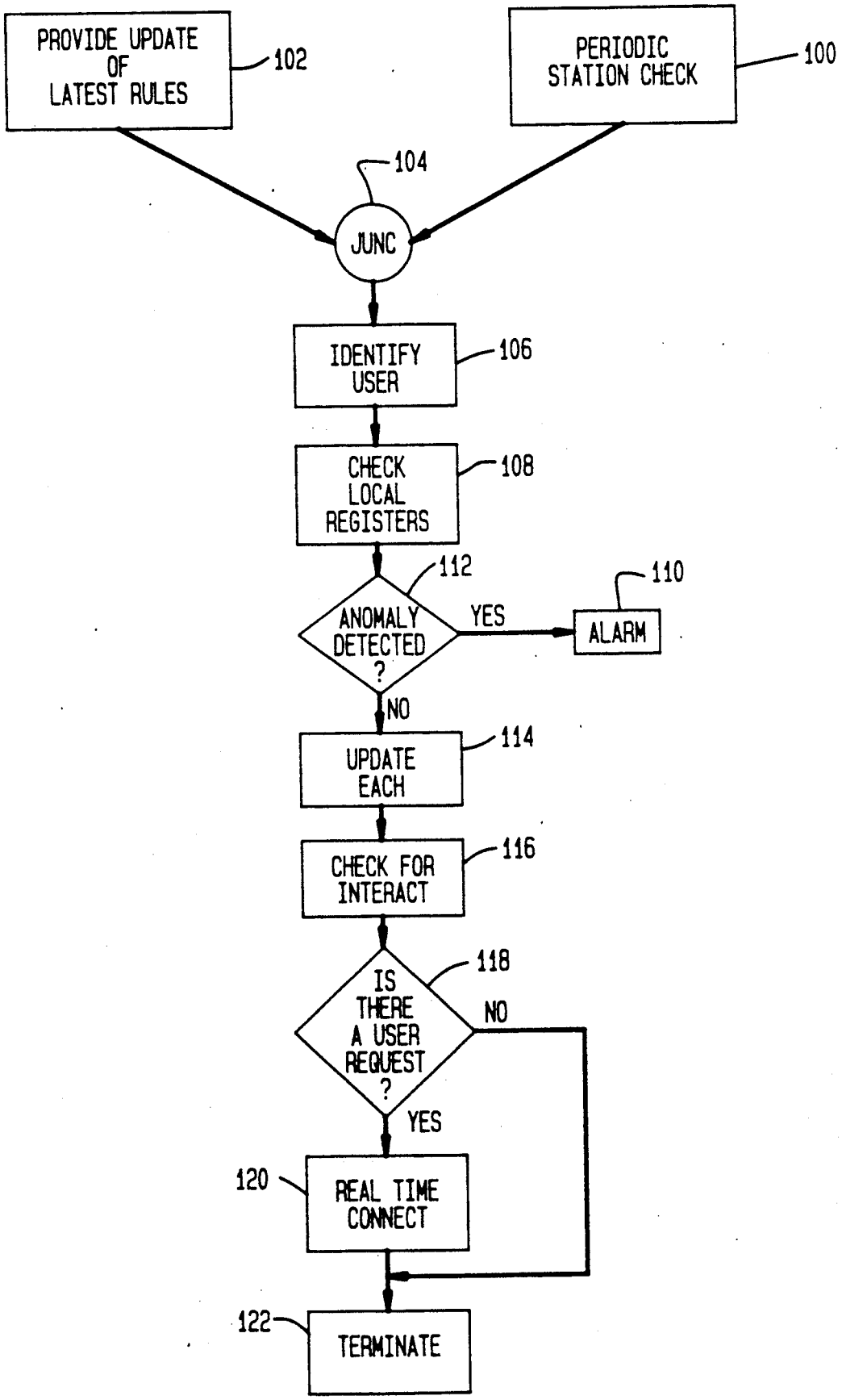
FIG. 3*a–c* illustrates flow charts for the data center.
Figure 3B:
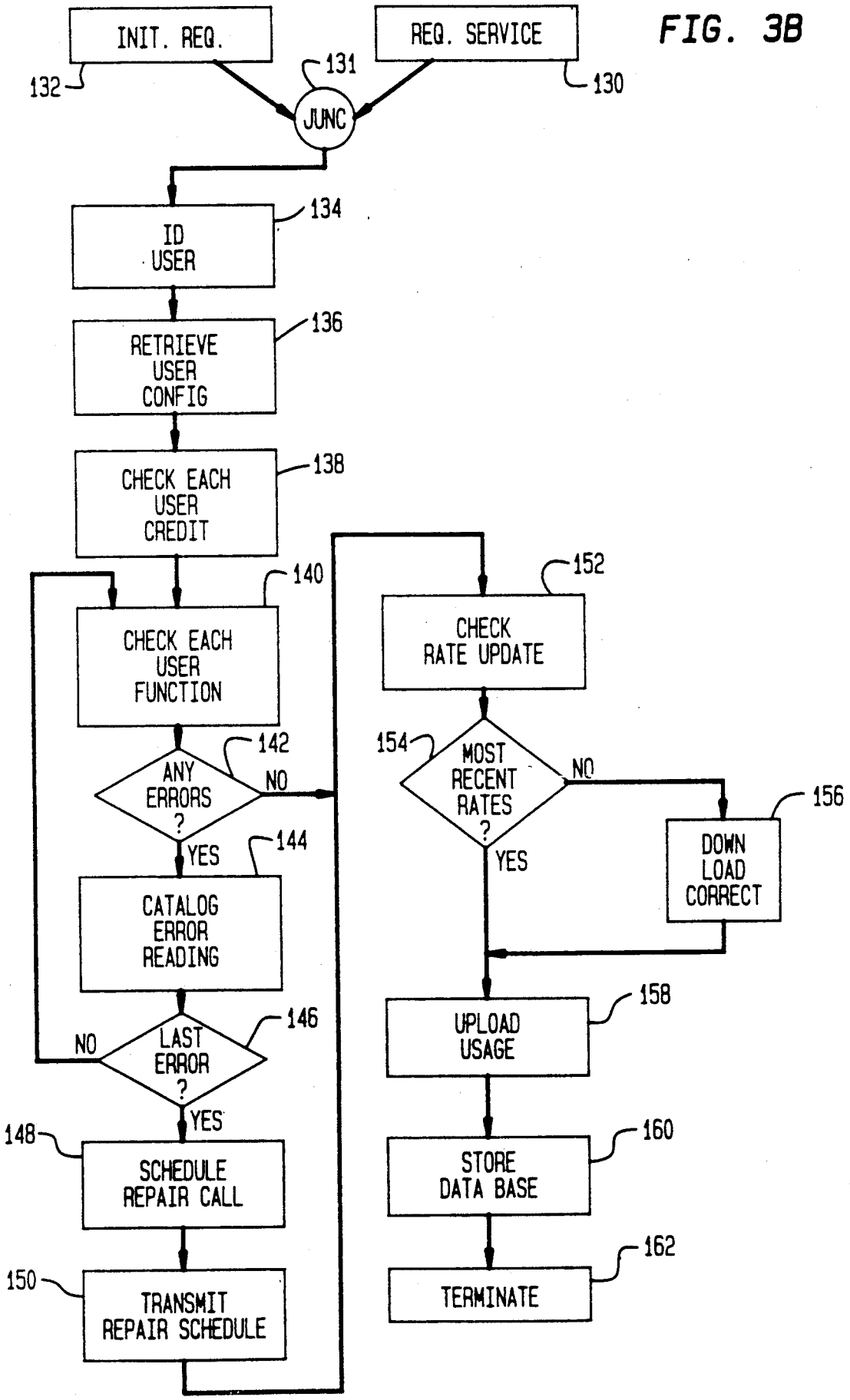
Figure 3C:
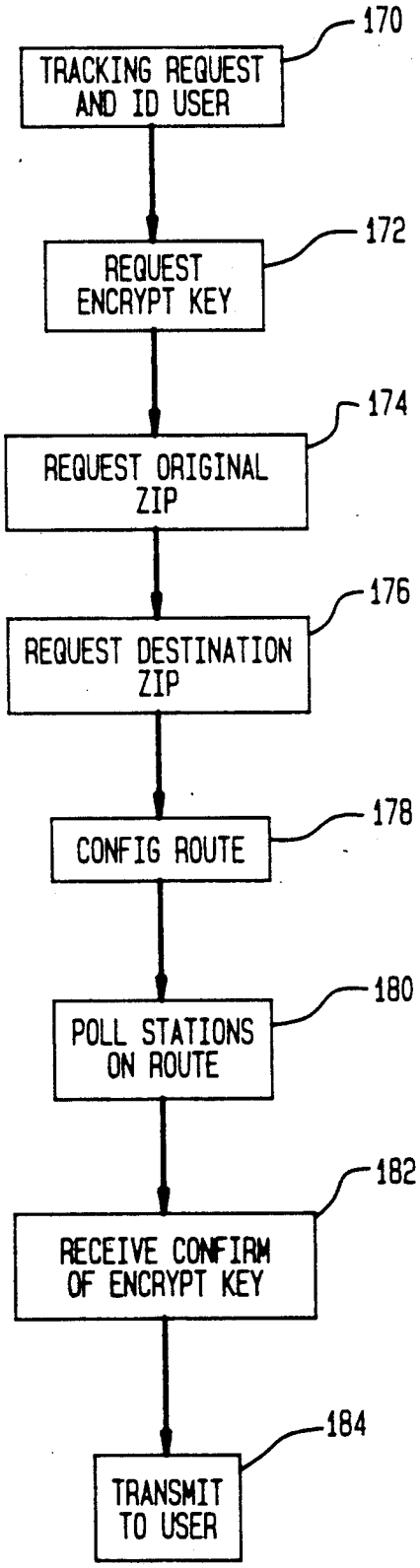

Referring to FIG. 3, a general flow chart illustrating the operation of the arrangement of FIG. 2 is shown. The flow chart consists of three portions, FIGS. 3*a*, 3*b*, and 3*c*. FIG. 3*a* illustrates the program routine governing issuance of appropriate updated instructions and status checking for compliance with certification operations in accordance with U.S. Postal Service rules and regulations. FIG. 3*b* illustrates a diagnostics and service routine followed by the central processor unit with respect to each of the local user stations by which appropriate diagnostic maintenance and service calls, as well as security monitoring and monitoring of specific internal functions of the postage meter having to do with secured aspects, such as the meter, certification, and descending register funds balances, may be maintained. FIG. 3*c* illustrates a software routine whereby two-way communication regarding the tracking of specific mailpieces may be accomplished upon user requests.

Referring to FIG. 3*a* compliance with U.S. Postal Service rules is maintained by ensuring that the data center continually and regularly updates the rates and regulations such as postal rates, bulk mail rates, mail size requirements, new zip codes, etc. The inquiry can be initiated by the data center as a periodic status check 100 or by a request to provide an update of the latest rules 102. The data center thus establishes a data link 104, identifies the user 106, as by a code stored in the local unit nonvolatile memory. The status of local registers are checked 108, and an alarm condition 110 raised if an anomaly is detected 112. In the absence of such a condition, the updating is performed 114 after which there is a check for interaction between the local register and the updating 116. Interrogative real time requests, such as from an on line user, can be dealt with at this time by checking if there is a request 118 and if a request is present establishing a real time condition 120 between personnel at the user location and the central station. Following this last procedure the routine is terminated 122.

Referring to FIG. 3B, the central unit routine for establishing diagnostics and servicing at a local user location is illustrated. The routine begins with a service request 130, initiated by the local user or a service request initiated 132 by the central unit. In either event, after establishment of channel communications 131, identification of the user 134 by retrieval 136 of a specific identification code stored within the permanent memory of the user location is made. The user configuration is then retrieved 136 at the central unit memory, and a credit check of the user is made 138. Next, each user function is checked 140 and a decision made as to whether an error exists. If an error does exist 142, the error reading is catalogued 144. An inquiry is made whether the prior error is the last error 146. If the error is not the last error, the system recycles to check additional user functions until an error free routine results. In this manner, each individualized user function may be reviewed. As discussed hereinabove, each piece of equipment contained within a user unit may be reviewed in this manner. Thus, units such as optical scanners, feeders, certification units, postage metering equipment, CPU diagnostic routines, and other routines designed to test and maintain each individual function contained within a respective user unit equipment may be accomplished. At the completion of a complete diagnostic check, and assuming no additional errors were found, a repair schedule call may be programmed 148 by the central unit in accordance with the schedule of the local repair technicians. Once a time schedule has been arranged 150, the schedule may be transmitted to the user for display upon local screen displays. If the user functions were error free, then the decision block after the checking of each user function, indicating no error, branches the program to a rate update routine 152. The rate update routine is also branched to at the completion of the transmission of a specific repair schedule, should errors have been found during the diagnostic programming check.

The check rate update examines the central program memory of each user unit to determine that the unit has the last, and most recent, rates programmed into the local user unit 154. If the local unit does not have the correct update, then a downloading 156 of a correct user rate schedule is made along the appropriate transmission channel to the appropriate memory location contained within the user equipment. At this point, the program continues by uploading all local usage data 158 from the local user unit. This local user update may include such information such as local user mailing volume, such as destination zip codes in a recent mailing time period, processing or certain types and sizes of mail, and other user workloads so as to enable the Postal Service, by maintaining such information in a stored data base 160, to forecast workloads, transportation requirements, management of asset inventory, creation of mailer profiles, and other information which may be employable to establish process controlling to better manage U.S. Postal Service resources. Furthermore, this information may be utilized to generate a series of reports to the user considering the status of the equipment, the history or record of user maintenance, and the quantity and time of service calls necessary for servicing the equipment. In addition, the ability of the central data station to communicate between itself and the user facility permits the central station to keep a permanent record, available for inspection by the U.S. Postal Service, to confirm uses of local users of such critical elements as postage requirements and error free data operation which best ensure integrity of the local system to the satisfaction of the U.S. Postal Service requirements, thereby enabling certification processes to be established allowing work sharing concepts to be employed for the purpose of reducing mailing rates. Following storage of the above discussed confirmation and the data base 160, the routine is terminated 162.

Referring now to FIG. 3C, a routine initiated by the local user through the central station for tracking specific pieces of mail based upon encryption keys placed by certification equipment on pieces of mail is illustrated. Thus, a tracking request 170 is received over the two-way data channel link 42 by the central unit 18. The central unit 18 then requests the encryption key 172 once communication and identification have been established between the central unit and the local user. The next piece of information requested is the originating zip code 174, and then the destination zip code 176. The central data station then configures the route 178 normally encountered through the U.S. Postal Service by a piece of mail originating from the input originating zip code and the destination zip code. The configured route will include each of the respective stations, including delivery channels, encountered by a piece of mail normally delivered between the respective inputted originating zip code and destination zip code. Once the configured route has been calculated by the central unit, each of the specific stations on the route are polled 180, again through the two-way communication link 42 through which the central unit has access, and the specific location of the particular encryption key is determined. Once confirmation of an encryption key at a specific location is confirmed 182, this information is transmitted 184 to the user station. The user station will then utilize this information, as will be set forth in further detail below, to determine the specific location of the piece of mail pursuant to the user request.

Figure 4:
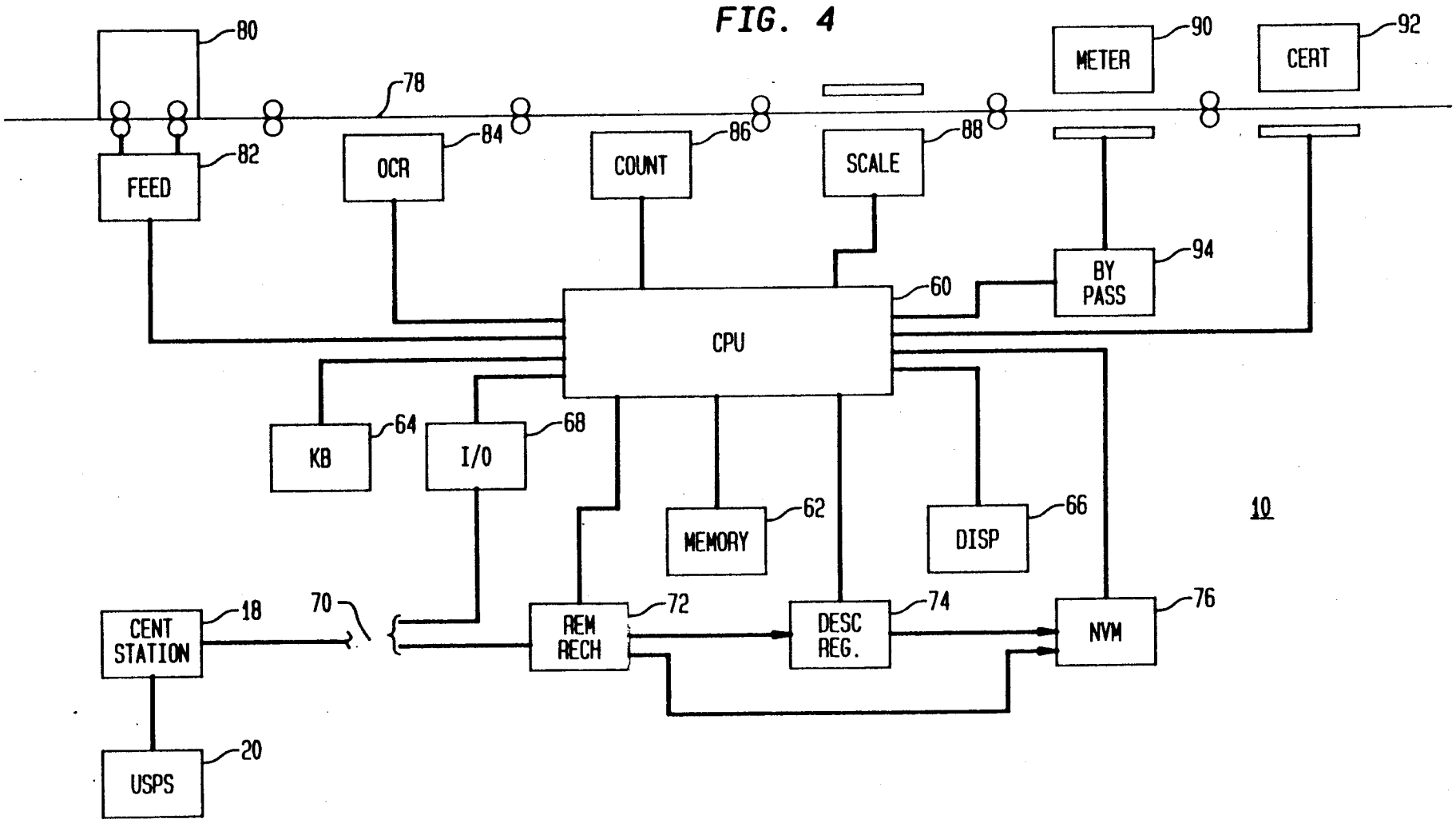
FIG. 4 is a more detailed block diagram illustrating a user station.

Referring to FIG. 4, the function block diagram illustrating the interrelationship of components within each individual user station is illustrated. The central user station operates under the control of a CPU 60, which includes a RAM memory and appropriate control registers. Coupled to the CPU 60 is a program memory 62 which defines the essential function of the system, including updating instructions and rates used in the local user units, diagnostic monitoring, a two-way communication link establishing a tracking facilite utilizing the encryptic key represented by the certification, and interface capabilities with respect to the central station for the downloading of training information which enables operators at local stations to understand and comply with specific requirements imposed by the U.S. Postal Service with respect to the certification process. Coupled to the CPU 60 are a keyboard 64 for the manual entry of data requests and other information into the CPU, display unit 66 and an I/O channel 68 coupled by means of a data link 70 to the central station 18. Accounting information and funding to the local user 10 are effected through the data link 70 from the central station 18 to the remote recharger mechanism 72, operating in accordance with conventional recharging techniques, such is disclosed in U.S. Pat. No. 4,097,923 issued to Eckert, Jr. et al. and assigned to the assignee of the present application. Remote recharging unit 72 charges a descending register 74, in conventional manner, which keeps track of descending balances charged from time to time in accordance with mail requirements. Non-volatile memory unit 76 is employed to maintain security of information during periods of time when local user unit 10 is not operating. Nonvolatile memory 76 receives descending register balances as part of a shutdown routine, along with other security data which may be applied from the active memory of the CPU 60. One of the features of the central unit 10 is that the remote recharging operation carried on in remote recharging circuit 72 is maintained through the data link 70 to the central station 18, and operates independently of the OFF/ON status of the local user unit 10 for monitoring purposes. Thus, even if the local unit 10 is turned off, central station 18 through data link 70 may inquire through the remote recharging unit of the status of certain pieces of information which are maintained either in the RAM memory portion of the CPU 60 during on-times of the unit 10 or in the nonvolatile memory 76 during inactive status periods.

The concepts of work sharing entail the performance of certain functions by the user in a secure manner so as to enable the user to apply not only postage but to also apply certification, as an imprint on the mail piece, which will be accepted by the postal service that the services certified were in fact performed by the user and thus enable the user to be entitled to further mail rate reductions. Communication in contrast may also be by means of a code or other form with the relevant information transmitted in encrypted format. The information may be scanned and used to automatically set the postal equipment at the user site to proper settings, both for postage and for usage scheduling, without direct user intervention, thus enhancing security and efficiency.

Certification information is provided to the CPU through a plurality of inputs along a mail path designated as 78. Mailpiece documents which are stacked in appropriate feeder-stacker unit 80 are, under control of CPU 60 through feeder-unit 82, driven along the mail path 78, past OCR unit 84 where printed material on the mailpiece is read, past counter station 86 where individual pieces are counted, to the scale unit 88 where the mailpiece is weighed, and thence to a metering station 90 for application of appropriate postage and finally to a certification station 92 where appropriate certification stamps may be placed on the mailpiece to indicate compliance of the mailpiece with all the criteria that have been set under work sharing requirements required under the U.S. Postal Service regulations. Since the unit may be capable of handling prefranked mail, a meter bypass network 94 operating under control of the CPU, provides for bypassing of the mailpiece of the metering station 90 without the necessary application of additional postage. Problems encountered in short-weight mail may be adjusted by appropriate decrement of the descending register balance in descending register 74 under program control through CPU 60, based upon differences detected by the computer between applicable postage rate requirements and the actual mail run being passed through the user station 10. An example of short-weight mail is disclosed in copending application, Ser. No. 285,146, filed concurrently herewith, and assigned to the assignee of the present application.

Figure 5A:
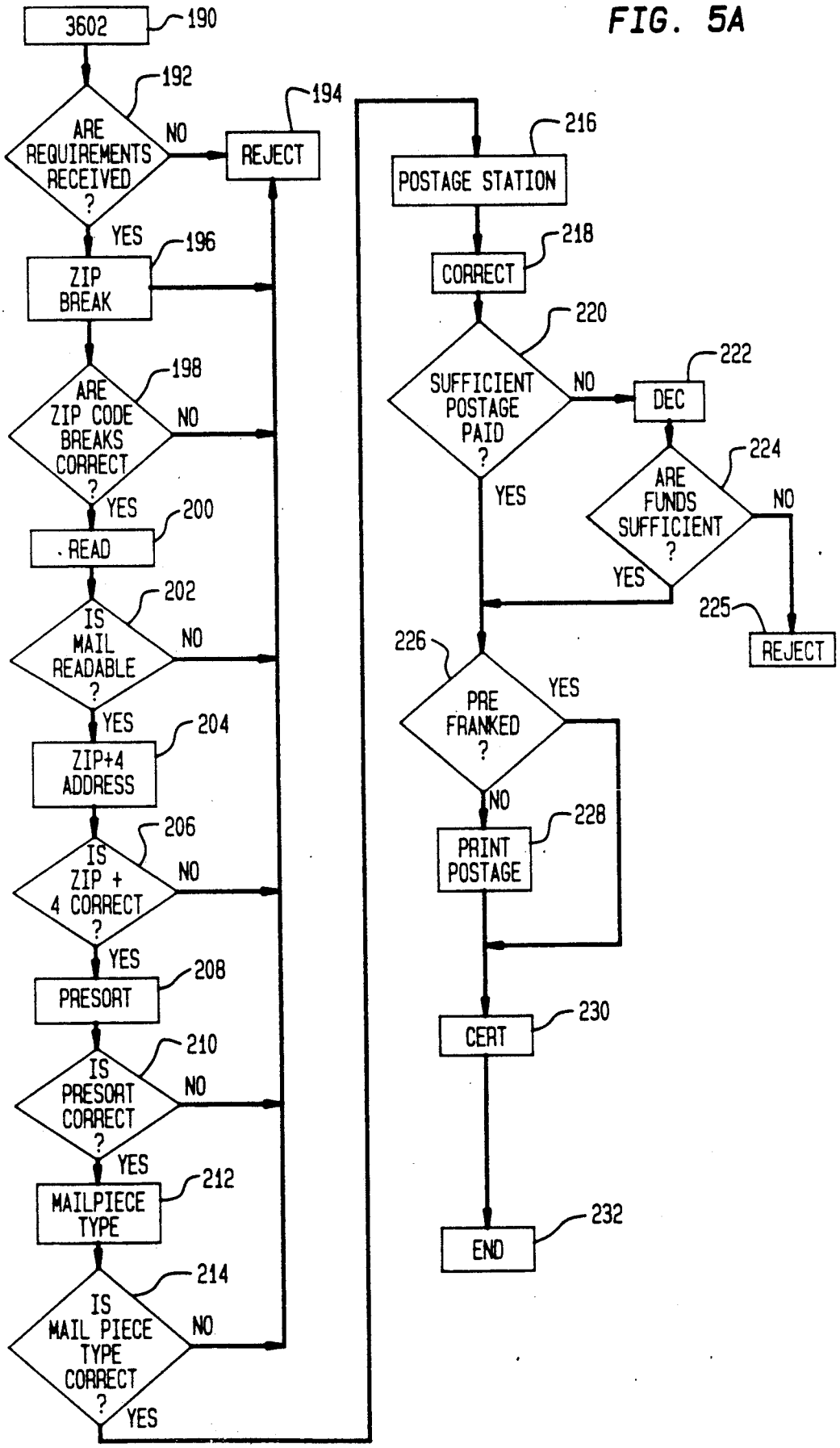
FIG. 5*a–d* are flow charts illustrating the operation of FIG. 4.
Figure 5B:
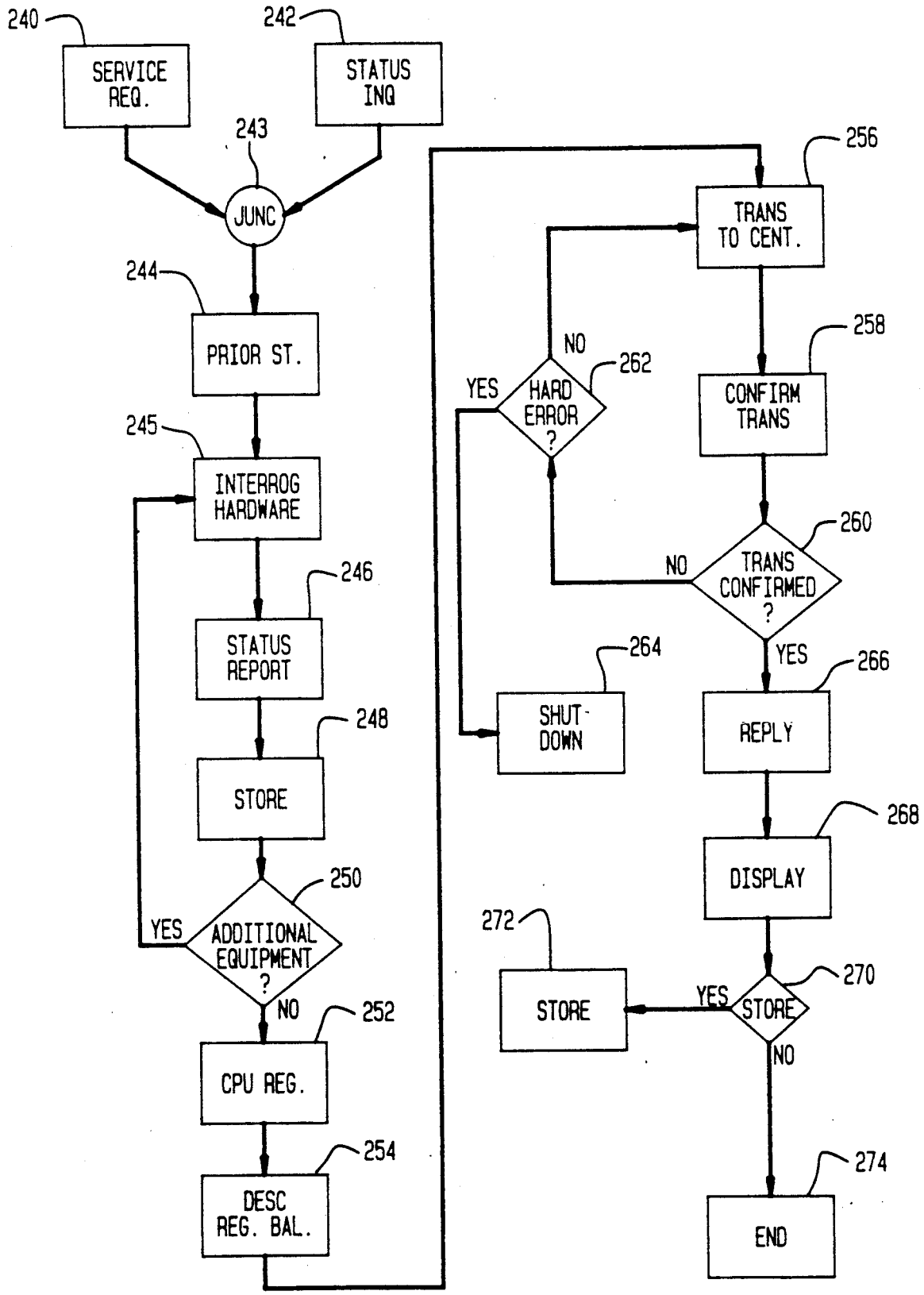
Figure 5C:
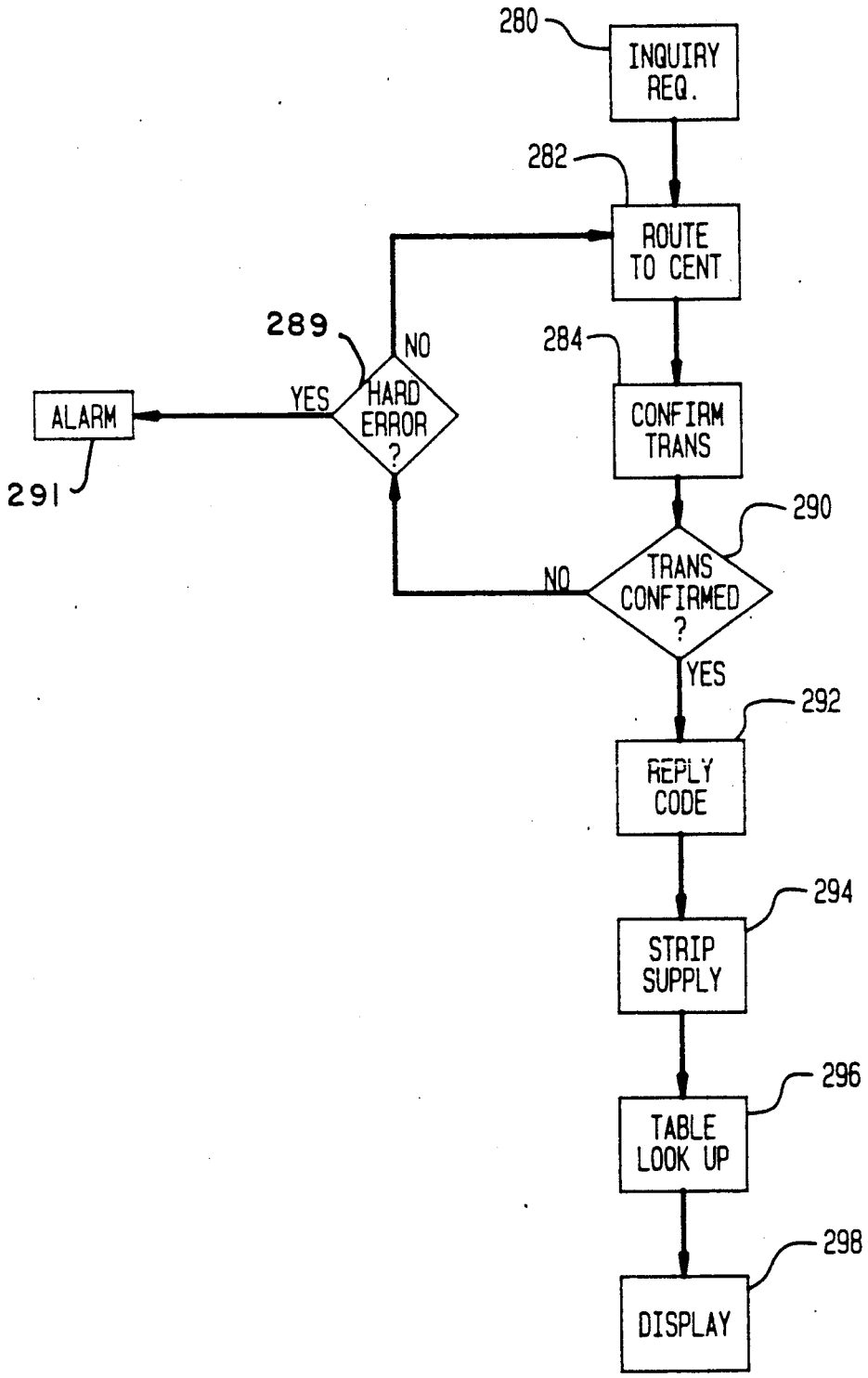

Referring to FIGS. 5*a*–5*d*, the specific software routines governing the operation of the user are illustrated. Thus, in FIG. 5*a* a work sharing flow chart is shown. In FIG. 5*b* the diagnostics flow chart is shown. In FIG. 5*c* mail tracking is shown, and in FIG. 5*d* training and other intercommunication system operations are illustrated. Operation of the system is a complete pass through including all stations, with reject operations taking place at one point, between the metering station and the certification station. It will be apparent to those skilled in the art that other rejection points may be placed along the mail path, however, the high speed nature of the data processing system, with an eye towards the economics, dictates as a preferred embodiment a single rejection station located at the downstream point. All data regarding specific mail runs are accumulated in the CPU, and a rejection or accept decision made just prior to entering the certification station. Thus, referring to FIG. 5*a*, first, ail of the data received is analyzed for 3602 requirements, including weight, volume, class of mail, applied rate, etc. This information is correlated by means of the OCR module, a count module and a scale module, taking into account previously inputted data either by means of the keyboard or by means of other inputting means such as an optical character read manifest or a data communication link which comprises a separate input channel into the CPU 60. Each of the elements shown on the flow chart of FIG. 5*a* are program selected in accordance with the program loaded into the CPU governing the application of a specific mail run and in accordance with the work sharing operation selected by the user. Thus, assuming a plurality of work sharing concepts selected by the user for a rate reduction, with the understanding that any one or more of the elements selected as shown in FIG. 5*a* may be eliminated in accordance with the different selected package by the operator, then conformance to the 3602 information 190 is achieved. An inquiry is made whether the 3602 information has been received 192. If not the routine is rejected 194, but if so zip code data is fetched 196. An inquiry is then made whether the zip code breaks are correct 198. If so, this has the meaning that mail has been presorted appropriately by zip code. If the inquiry 198 is "no" the routine is rejected, but if the response is "yes" the data relative to readability 200 is determined 202. If "no" there is a reject but if "yes" this indicates that the mail complies with a certain zip plus 4 format 204 thereby eliminating the need of the Postal Service to have multiple format reader devices. Data relative to the zip plus 4 address information is fetched 204. An inquiry is then made 206 whether the zip plus 4 data is correct. If not, the routine is rejected, but if a zip plus four address is determined, this means that the mail has been pre-zip coded with the extended zip code thereby reducing the sort capacities and procedures required by the Postal Service. If the zip plus 4 is correct, the routine then proceeds to a presort station 208. An inquiry is made whether the present data is correct 210 and if not the routine is rejected but if the response is "yes" this indicates that the mail has undergone certain presorts, thereby further reducing the work load of the Postal Service, and then mailpiece type the mail is all of a common size and type, thereby further reducing the amount of segregation necessary by the Postal Service, and thence to a postage station, where in accordance with all of the foregoing requirements, the correctly applied postage is confirmed as having been placed upon the mailpiece, either by the metering station, or by means of a pre-applied postage franking mechanism. Failure to apply the correct postage in pre-printed postaged mailpieces does not result in rejection of the mailpiece, but simply results in the appropriate debiting made to the decremented register in the local user's unit, and thence having the mailpiece passed to the certification station for certification indicating that correct postage has been debiting to the account of the user, even though the same may not be appropriately indicated on the mailpiece. By including the certification of correct postage, one last check, that of short paid mail, also does not have to be made by the Postal Service. Thus, compliance with each of the requirements set forth in the flow chart of FIG. 5*a*, representative of a maximized work sharing concept, substantially reduces the work burden of the Postal Service. This enables substantial reduction to be passed back to the user in the form of rate reductions. Compliance with the foregoing, as previously stated, is physically indicated on the mailpiece by means of an appropriately entered certification. Certifications may be appropriately encrypted to prevent duplication, and may be encoded in such a manner as to afford the Postal Service means to validate such certification on a random spot check basis. Methods and apparatus for effecting such verification based upon encryption are disclosed in U.S. Pat. No. 4,641,346, assigned to the assignee of the present application. FIG. 5*a* also illustrates between each of the respective blocks a plurality of decision blocks or diamonds, indicating compliance or noncompliance with the operation indicated in the previous block. The affirmative outcome of the decision block, indicated by a Y, indicates passage to the next decision making step. A NO or inability to comply with the requirements in the prior block is indicated in the decision block with an N. The outcome of the N is the passage of a signal through the reject station. Such passage to the reject station has been indicated with respect to the first block, and it will be understood that each of the subsequent decision blocks possesses similar capabilities. After the mailpiece size check 214, the mail piece is passed to a postage station 216 where a correct postage check and tested 220 is made routine is initiated 218 to indicate whether or not the postage to be applied is correct. Assuming it is correct, postage is printed and the mail is passed to certification 230. If the postage is not correct, the program is passed to the step of decrementing the descending register 222 by the correct amount. If the descending register 222 is not decremented properly, due to an inquiry 224 as to insufficient funds in the descending register or the like, the mailpiece is rejected 225. If it is accepted, it is also passed onto the certification station 230. An inquiry is made whether the mail piece is pre-franked 226. If the mailpiece is not pre-franked, the program branches through an additional postage printing operation 228. If so the mail is certified and the program is ended 232. Referring now to FIG. 5*b*, a flowchart indicating the operation of the system for effecting service diagnostics is illustrated. The data center interrogates the user system periodically to determine the status of the equipment. Information that is obtained during the interrogation may include the usage rate and status of various component s and subcomponents of the system. Information may also include status of the descending registers and any other secured aspect of the equipment which is of interest to the central station and also to the user. This information is utilized to generate a series of reports to the user, including monthly statements, concerning the status of the equipment, the need for user maintenance and the need for service calls by the data center. The system may also enable the scheduling of the service call by leaving a message on the equipment indicating that a service call has been scheduled at a particular time, including leaving the name of a specific service individual, all of which may be displayed on the user's terminal. With specific reference to FIG. 5*b*, service request 240 or status inquiries 242 will have a common effect 243 of initiating this routine. Thus, the status inquiry which may originate from the data center, or a service request, which may originate from the user, both act first to activate and display any prior stored information 244 regarding previous service requests or a service call that may already be scheduled and in progress for display by the operator. The system next interrogates each of the specific hardware elements 245 shown in FIG. 4, which interact/react with the mail feed path. Thus, the hardware interrogated will include feed mechanism 82, or OCR reader 84, the counter 86, the scale 88, the meter 90 and the certification 92. Each of these devices will include appropriate monitoring circuitry for indicating, in a specific stored location, each of the current status operations of each of these devices. Status may be monitored by means of a startup initialization routine effected by the CPU, and continuously monitored during operation of a mail feed path. Two types of monitoring conditions are evident. First, a monitor condition which suggests the need for service but will not interfere with the operation of the feed path. Such monitoring condition will be continuously indicated by means of a status check. These may be referred to as soft defects. Additional defects which would actually interfere with the operation of the device, such as inability to read at the OCR unit or inability to apply postage due to a defect in the meter, or other inabilities of inoperative devices, known as hard defects, will cause a shutdown of the mail path and provide to the CPU an indication of the specification problem by virtue of the status of each of these devices. The hardware elements are interrogated in turn, and a status report 246 is placed in appropriate memory locations in CPU unit 60. Thus, interrogation hardware interrogates a specific hardware unit, and passes the information upon receipt to the status report area of the computer where it is stored 248 in the appropriate location. As indicated in the following decision diamond 250, if additional equipment needs to be interrogated, an appropriate loop is made back to the interrogated hardware 244 and the previous steps repeated. When all hardware has been interrogated, the interrogation process continues to the CPU registers 252 where sampling of each appropriate register in the CPU which keeps track of specific pieces of information relative to the mail usage is indicated. Thus, the CPU register storage will include information such as statistical data relating to use of the device, number of times appropriate categories and different weight classes have been employed, number of classes used, geographic distribution of mail, statistical data relating to the use of zip codes, statistical data relating to the use of specific mailpieces, statistical data relating to the use of bulk mail versus individual piece mail, specific data relating to the use of classification of mail, and other types of information utilized by the specific apparatus which are part of the certification procedure. Next, the descending register balance is interrogated 254, and then all of the data is accumulated appropriately and transmitted through the high speed data link 70 to the central station 256. Suitable data transmission techniques are employed with appropriate error checking and confirming feedback signals 258. Upon failure to confirm transmission, as indicated in the decision block 260 following the confirmed transmission block 258, retransmission takes place. Although not indicated, standard techniques for repeating the transmission a multiple number of times awaiting error-free transmission may be employed. Final failure to transmit the information error-free will result in a specific alarm raised at the central station indicating that the local user unit is inoperative for transmission purposes. Such a defect would be considered a hard defect, and would result in shutdown of the machine. The hard error decision block 262, based upon a multiple number of unconfirmed transmissions, would result in shutdown, 264. Upon the confirmation of appropriate transmission, any reply from the central station is awaited by the local user unit in the next REPLY block 266. This reply may include information results regarding diagnostics concerning the local user's machine; it may also include a specific display 268 provided by the central station of the time, date and name of the mechanic who will appear to fix the local user's unit. If following a store inquiry 270, the information displayed is to be stored it is placed in the appropriate storage 272 of the CPU for later display upon further interrogation routines or upon status checks by the local user. The routine at this point ends 274.

It will be apparent that the certification stamp thus assures that all critical components are in proper working order as well as that the postage applied is accurate.

Flow chart 5*c* illustrates the concept of mail tracking. The mail tracking utilizes the encryption placed upon the mailpiece by the certification mechanism. It should be understood, however, that mail tracking can take place by additional encryption or bar coding of information on the mailpiece, unrelated to the certification stamp placed thereon. In this embodiment, since the certification stamp is part of the operational process of the machine, and is an encryption coded key line, it is convenient for the system to utilize this keyline piece of information for mail tracking purposes. After release of the mailpiece from the local user's station and delivery to the central postage facility, and assuming the use of all automatic equipment in the central postage facility based upon the work sharing concepts reducing the amount of effort necessary by the central post office, information is captured at each entry point. By the use of appropriate OCR or other reading equipment, each entry point into the delivery chain after release of the mailpiece by the local user may be a data input point. Thus, the delivery service may possess input equipment which allows each piece of mail upon transfer to the delivery service to be inputted into a central data base system indicating the specific location of the mailpiece. Upon transfer of the mailpiece from one location to the next, an appropriate tag or data line is placed upon the mailpiece certification encryption keyline when entered into the data base. By coordinating the data through the U.S. Postal Service central data base each entry point into the system, the operator may be able to inquire, through the central station and thence through to the U.S. Postal Service, by keyline, of the specific location of a mailpiece. Since each mailpiece certification keyline will have a tag attached thereto, which is continuously updated as the mailpiece goes from input point to input point along the delivery chain, the user should receive back an indication based upon such added keyline of the location of the specific mailpiece. In this way, the keyline tracking on the mail or parcel is utilized both to identify the parcel and by so doing with suitable encryption enable the mechanism to identify its location in the system. Referring now to the flowchart, each step in this process as it occurs in the user status CPU is illustrated. First is the inquiry step 280, effected by transmitting an inquiry request through the keyboard of the local user station into the CPU and thence to the I/O device and across the datalink into the central station. In the central station such inquiry request is recognized and transmitted between the two CPUs out across the datalink to the U.S. Postal Service communication facilities. In the local unit 10, the inquiry request 280 is routed to central 282 and a confirmed transmission 284, with hard error time out 289 and appropriate alarm 291, results following a inquiry 290. A positive response in a reply of a code line 292 which is analyzed with the CPU to strip out the suffix locator code 294, which is then compared in a lockup table base 296 previously incorporated in the CPU from downloaded information received from the central station for identification based upon such suffix, and the result displayed 298 on the display terminal of the local user.

Figure 5D:
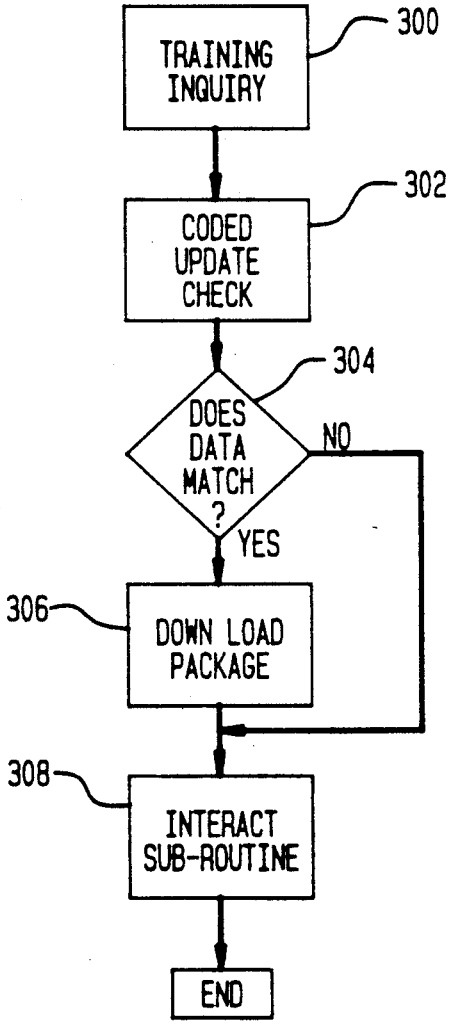

The downloading of information for the purpose of allowing communication such as training packages and other information to be transmitted from the central unit to the local units is illustrated in FIG. 5*d*. The ability to download information in large quantities allows the central station to provide training packages to the local station, which may be employed by the local user for training new employees and acquainting new employees on various postal procedures and other means and manners which by postal efficiency may be achieved under the work sharing concept. This includes training current employees in new techniques in mailing and also may be employed as a self-instruction mode interactively with the terminal for assisting in the training of employees. The system also allows downloading of third party advertising to allow a customer to provide third party advertising, thereby further discounting the cost of their own mailing, or to download interesting graphics or other type of advertising for a particular mailing.

Referring to FIG. 5D, a training inquiry is initiated 300 by keyboard and local users. The request is routed to the data center. In response, the data center transmits a code representing the most recent updated training package 302. Upon receipt, the local user compares this code to its most recent coded update previously stored in local memory 304. If the latest data center program matches the stored program, the downloading step is shipped 306 and the training program begins as an interactive subroutine 308. If it is not the latest version, the downloading is completed and the subroutine runs with the latest version in local memory. Thus, each local user training session will employ the latest updated training package.

The foregoing preferred embodiment may be varied within the spirit and scope of the invention, the expression of which is set forth in the appended claims.

What is claimed is:

1. A communication system for processing information for distribution, comprising: a central data station, a plurality of user stations, each of said user stations including a plurality of components forming a path for the proper distribution of said information, a communication link interconnecting said user stations with said central data station, said central data station including means for periodically interrogating via said link a user station for determining the operational status of each of said components, said user station including as one of its components a certification means for certifying that all said components are operational, and means for applying a visual indication of said certification to said information when distributed.

2. The system of claim 1, wherein said distribution is based on prefranked enclosures for distribution within a prepaid delivery system, and wherein said certification certifies to the delivery authorities the accuracy of the value of the prefranked enclosure.

3. The system of claim 1, wherein the path formed at each of said user stations is a secure path.

4. The system of claim 1, wherein the communication link is a secure link.

5. A communication system for processing information for distribution in an enclosure based on prepaid distribution, comprising: a plurality of user stations, each of said user stations including a plurality of components including a counting means and a weighing means for determining the value of said prepaid distribution for each said enclosure for the proper distribution of said information, a central data station, a communication link interconnecting said user stations with said central data station, said central data station including means for periodically interrogating a user station for determining the operational status of each of said components; said user station including among its components a certification means, accounting means, and control means for processing said enclosure and accounting properly for said value irrespective of any prepaid valuation on said enclosure; and means for applying a visual indication of said certification to said enclosure.

6. An apparatus for performing postal functions in a multicomponent interrelated system comprising: a central processor, a plurality of component means for performing postal functions based on a predetermined input, said central processor monitoring the operation of each of said components, means coupled to said central processor for monitoring compliance of each of said components with a standard for acceptability of each of said postal functions, and means for certifying the resultant product of said apparatus as being in accordance with said standards.

7. The apparatus of claim 6, wherein one of the postal functions performs is calculating appropriate postage.

8. The apparatus of claim 7, wherein said components include counting means.

9. The apparatus of claim 7, wherein said components include weighing means.

10. A central data station for use in a communication system for processing information for distribution, said central data station comprising means for connecting to a communication link to a plurality of user stations each having a plurality of mail processing components forming a path for the proper distribution of said information, means for periodically interrogating via said link a user station for monitoring the proper operational status of each of said mail processing components, said user station including as one of its components a certification means for certifying that all said components are operational, and means for authorizing a user station maintaining the proper operational status of its mail processing components to apply a visual indication of said certification to said information when distributed.

11. A postage accounting device comprising a microcomputer having an accounting register, said microcomputer comprising means for determining first amounts of postage to be imprinted on each of a plurality of pieces of mail in accordance with a given algorithm based upon predetermined characteristics of said pieces of mail, means for imprinting said first amounts on the respective pieces of mail and decrementing said accounting register by said first amounts, and further comprising means for determining if said pieces of mail have said predetermined characteristics, and means responsive to the operation of said characteristic determining means for decrementing said accounting register in accordance with a second algorithm if said pieces of mail do not have said predetermined characteristics.

12. The postage accounting device of claim 11, wherein said imprinting means further comprises means responsive to the operation of said characteristic determining means for imprinting a certification on said pieces of mail that required postage for mailing said pieces of mail have been accounted.

13. A method for assuring proper accounting to the Postal Service of posted mail pieces notwithstanding the postage amount shown on the mail piece, comprising the steps:

(a) providing at a mailer's facility a calibrated secure mail piece scale, (b) periodically certifying the accuracy and functionality of said scale, (c) while the scale certification is in force, using the scale to weigh mail pieces to be delivered to the Postal Service and determining the proper postage in accordance with current Postal Service tariffs, (d) applying the proper postage as determined in step (c) to the mail piece as required, and comparing any pre-posted mail pieces against the proper postage as determined in step if not pre-posted (c), (e) accounting to the Postal Service for the applied postage and for any additional postage due in any short paid preposted mail pieces, (f) at the mailer's facility applying to the said mail piece a visual certification mark and, (g) delivering the mail piece with its applied certification mark to the Postal Service, the Postal Service recognizing the certification mark as assuring proper postage accounting to the Postal Service and therefore delivering the mail to the addressee notwithstanding the mail piece may be short paid based on its shown postage and without collecting any additional postage from the addressee.

14. The method of claim 13, wherein any additional postage due on short paid pre-posted mail pieces is debited against the mailer's postage meter and where a $\pi$postage meter is not used, debiting against an advance deposit account maintained by the mailer.

15. The method of claim 14, comprising providing a computerized facility having a central database containing up-dated Postal Service tariffs, providing associated with the scale a computer linked to the central database, using the computer at the computerized facility to check from time to time the functionality of the scale to assure its certification remains in force.

16. A communication system for processing information for distribution, comprising: a central data station, a plurality of user stations, each of said user stations including a plurality of components forming a path for the proper distribution of said information, a communication link interconnecting said user stations with said central data station, said central data station including means for periodically interrogating via said communication link a user station for determining the operational status of each of said components, means located within said central data station for detecting an error condition in any one of said components, and means at said central data station for transmitting a condition signal from said central data station to said user station for indicating to said user station said error condition.

17. The system of claim 16, wherein said condition signal includes a signal for disabling said user station.

18. The system of claim 16, wherein said user station includes means responsive to said condition signal indicating an out-of-date rate schedule for updating said user rate schedule.

19. The system of claim 16, wherein said central station includes means responsive to said condition signal indicating a malfunction requiring repair for scheduling a repair, and means for transmitting data signals representative of said repair schedule to said user station.

20. The system of claim 16, wherein said central station includes means responsive to said condition signal indicating an out-of-date rate schedule for updating said user rate schedule.

21. A communication system for processing information for distribution, comprising: a central data station, a plurality of user stations, each of said user stations including a plurality of mail processing components forming a path for the proper distribution of said information, a communication link interconnecting said user stations with said central data station, said central data station including means for periodically interrogating via said communication link a user station for determining the operational status of each of said components, means located within said central data station for detecting an error condition in any one of said mail processing components, and means at said central data station for transmitting a condition signal from said central data station to said user station for indicating to said user station said error condition.

22. A communication system as claimed in claim 21, wherein the distribution path is a secure path, and the communication link is a secure link.

23. A communication system for processing mailer-related information for distribution to mailers, comprising: a computerized central data station, a plurality of user mailer stations, each of said user stations including a computer controlling a plurality of components useful in processing mail at the user station facility, a communication link interconnecting said user stations with said central data station, said central data station including means for periodically interrogating via said communication link a user station for determining the operational status of each of said mail processing components and for receiving back from the user station operational status information, means located within said central data station in response to said user station operational status information for detecting an error condition in any one of said components, and means at said central data station upon detecting an error condition for transmitting a condition signal from said central data station to said user station for indicating to said user station said error condition.

24. The system of claim 23, wherein said condition signal includes a signal for disabling said user station and a report for informing the user station of the status of its mail processing components in the absence of said signal for disabling.

25. An apparatus for performing postal functions in a multicomponent interrelated system comprising: a central processor, a plurality of means for performing postal functions for calculating appropriate postage based on a predetermined input, said central processor monitoring the operation of each of said components, means coupled to said central processor for monitoring compliance of each of said components with a standard for acceptability of each of said postal functions, means for certifying the resultant product of said apparatus as being in accordance with said standards, a communication means for communicating with a central data facility, said central processor including first means responsive to a signal received from said central data facility for providing a response signal indicative of the status of select ones of said plurality of means, and second means responsive to a non-compliance status response from said central data facility for causing an alarm condition in said central processor.

26. The apparatus of claim 25, wherein said components include counting means.

27. The apparatus of claim 25, wherein said components include weighing means.

28. The apparatus of claim 25, wherein said components include postage metering means.

29. A central data station for use in a communication system for processing mailer-related information for distribution to mailers, comprising: a computer, means for connecting said computer to a communication link to a plurality of user mailer stations each having a computer controlling a plurality of components useful in processing mail at the user station, means for periodically interrogating via said communication link a user station for determining the operational status of each of said mail processing components and for receiving back from the user station operational status information, means in response to said user station operational status information for detecting an error condition in any one of said components, and means upon detecting an error condition for transmitting a condition signal to said user station for indicating to said user station said error condition.

30. A mailer station for use in a communication system for processing mailer-related information for distribution to mailers, comprising: a computer controlling a plurality of components useful in processing mail, means for connecting the computer to a communication link to a central data station, means for allowing said central data station to periodically interrogate via said communication link the computer for determining the operational status of each of said mail processing components, means for transmitting back to the central station operational status information, and means for receiving from said central station a condition signal indicating to said user station a error condition has been detected in any one of said mail processing components.

31. A method of maintaining integrity in a multiuser certification system wherein a central data station is coupled to a plurality of user stations over a data link, wherein each of said user stations employs a plurality of components which are integral to the security of said system, comprising the steps of:

periodically sampling a user station from said central station over said data link;

scanning each of said components during said sampling;

deriving condition data representing the condition of each said component during said scan;

transmitting said condition data from said user station to said central station;

said central station analyzing said data to determine the existence of an error condition;

and responding to an error condition by transmitting a condition signal to said user station.

32. The method of claim 31, wherein said user station is disabled in response to said condition signal.

33. The method of claim 31, further including the steps of:

determining in response to said error condition the existence of a repair condition;

scheduling at said central station a time for repair of said condition and creating a repair data signal representative thereof and;

transmitting to said user station said repair data signal to thereby indicate to said user the schedule for said repair.

34. A system for facilitating mail processing operations by separate users having mail facilities comprising: a computerized central data station having a database and monitor means, a plurality of user stations each containing computerized means for performing mail-processing functions and having a database containing Postal Service tariffs, means at said central data station for maintaining in its database current Postal Service tariffs, a communications link connecting each of the user stations to the central data station, means at said central data station for monitoring the operation of each of said user stations, and means for generating at said central station a record of the operational status at each of said user stations.

35. The system of claim 34, further comprising means for interrogating each user station to determine whether the Postal Service tariffs in its database are current, and means for updating said user station database from information stored in the central station database.

36. The system of claim 34, wherein said central station database includes current Postal Service rules and regulations, and means at each user station for downloading from the central station database into its own database a copy of the current Postal Service rules and regulations.

37. An apparatus for performing postal functions in a multicomponent interrelated system comprising: a user station having a central processor, a plurality of means at said user station for performing postal functions for calculating appropriate postage based on a predetermined input, said user central processor monitoring the operation of each of said components, a central station having means coupled to said user central processor for monitoring compliance of each of said components with a standard for acceptability of each of said postal functions, and means for generating at said central station a record of the status of each of said components, and means for producing said record upon request.

38. The apparatus of claim 37, wherein said user station includes means for monitoring postage used at said user station, and wherein said central station includes means for keeping track of each user's postage requirements.

39. The apparatus of claim 38, wherein said central station includes means for monitoring postage of a user station, and the central station includes means for recharging said user station.

40. The apparatus of claim 38, wherein said user station includes means responsive to a data transmission from said central station for recharging said postage monitoring means.

41. An apparatus for performing postal functions for a user in a multicomponent interrelated system comprising: a user central processor, a plurality of means for performing postal functions for calculating appropriate postage based on a predetermined input, said user central processor monitoring the operation of each of said components, means coupled to said user central processor for monitoring compliance of each of said components with a standard for acceptability of each of said postal functions, means for certifying the resultant product of said apparatus as being in accordance with said standards, a communication means for communicating with a central data facility, said user central processor including means for storing mailing data, means for storing funding and means for storing volume uses, means for intercommunication from said central data facility with said user central processor to access each of said means for storing, whereby said central facility can establish a data base, means for manipulating said data base at said central facility to establish processes to better manage an entity of the system.

42. The apparatus of claim 41, wherein said system includes a distributor, and the data base of said central facility is used to forecast workloads, transportation requirements, the management of asset inventory, and the creation of user profiles for said distributor.

43. The apparatus of claim 41, wherein said postal functional performing means at the user facility employs standardized fonts.

44. The apparatus of claim 41, wherein said central facility includes data processors, said data processors including a first communication link to an official postal authority for monitoring data at said central facility, and a second communication link to said user central processor for communication between said central data facility and said user central processor.

45. The apparatus of claim 44, wherein the central facility includes two sets of data processors, each associated with one of the communication links, and means coupling said two data processors.

46. The apparatus of claim 41, wherein the user facility includes means which responds to said central facility interrogating the user periodically to determine the status of the components located thereat, said interrogation deriving from user status data representing the usage rate and status of the various components and sub-components of the system.

47. The apparatus of claim 46, wherein said central data facility includes means which responds to said status data to generate a series of reports to the user reporting the status of the equipment, the need for user maintenance and the need for service calls.

48. The apparatus of claim 47, wherein said central facility includes means which responds to said status data to enable the scheduling of service calls by leaving a message on the equipment indicating that a service call had been scheduled at a particular time.

49. A system for tracking an article through a delivery system employing a plurality of uniquely identified delivery stages, comprising: a user station for preparing said article

50. A system for tracking an article through a delivery system employing a plurality of uniquely codified delivery stages, comprising: a user station for preparing said article for entry into said system, said user station including codification means for placing a tracking code on said article, a communication link connecting said user station to a central data station, said central data station including means responsive to a tracking request for interrogating each of said delivery stages over said communication link, means responsive to receipt of a response including said tracking code and said unique identification code for storing same, means for automatically stripping off said identifying code and comparing same to a data base located at said central station for identifying said delivery stage, and means for transmitting the identity of said delivery stage to said user station.

51. A system for tracking mail articles through a mail delivery system, comprising a plurality of separate delivery stages in the system for the mail, each of said delivery stages comprising means for recognizing and storing tracking codes associated with said mail articles, a user station for preparing mail articles for entry into said delivery system, said user station including coding means for placing a tracking code on said mail articles, a computerized central data station; communication links connecting said user station to said central data station and said delivery stages to said central data station, said central data station including means responsive to a tracking request for interrogating each of said delivery stages over said communication link for the presence thereat of the mail articles being tracked, means responsive to receipt of a response from a delivery stage that the mail article including said tracking code is present for storing the current location of said mail article, and means for transmitting to said requesting user station the current location of said mail article being tracked.

52. The system of claim 51, wherein said central data station maintains a database of coded mail articles and their location in the delivery system from the time the coded mail article enters the delivery system to the time it exits from the delivery system by communications from each delivery stage through which the mail article passes.

53. The system of claim 51, wherein each delivery stage comprises a computer controlled database, and means are provided for storing in its database the identification of any mail article received whose tracking code is recognized.

54. An apparatus for performing postal functions in a multicomponent interrelated system comprising: a central processor, a plurality of component means for performing postal functions for calculating appropriate postage based on a predetermined input, said central processor monitoring the operation of each of said components, means coupled to said central processor for monitoring compliance of each of said components with a standard for acceptability of each of said postal functions, and means for certifying the resultant product of said apparatus as being in accordance with said standards, said means for certifying including means for placing a certification code including an identification code on said product, said certification code positioned on said product for tracking said product through a delivery system employing a plurality of uniquely codified delivery stages, a central data station, said central data station including means responsive to a tracking request for sampling each of said delivery stages over a data line, means responsive to receipt of a response including said code and said identification code, means for stripping off said identifying code and comparing same to a data base located at said central data station for identifying said delivery stage, and means for transmitting said delivery stage identification information to said central processor.

55. A method of tracking an article through a multistage delivery system including a certified user station and a central data station by using the certification code of said user station, comprising the steps of:

(a) placing a certification code certifying accounting of the delivery charge of said article through said multistage delivery system, said code including an identification code positioned on said article for tracking said article through said multistage delivery system employing a plurality of uniquely codified delivery stages;

(b) initiating a tracking request from said user station and to said central data station; and (c) said central data station responding to said tracking request by sampling each of said delivery stages over a data line and by:

(i) responding to receipt of a response including said identification code by comparing said identification code to a data base for identifying said delivery stage and thereby locating said article; and (ii) transmitting said location to at least one of said user stations in said delivery system.

56. A method of tracking a mail article through a multistage mail delivery system including a certified mailer station and a central data station by using the certification code of said mailer station, comprising the steps of:

(a) placing a certification code certifying accounting of the postal charge of said article through said multistage mail delivery system, said code including an identification code positioned on said mail article for tracking said mail article through said multistage mail delivery system employing a plurality of uniquely codified delivery stages;

(b) initiating a tracking request from said mailer station to said central data station; and (c) said central data station responding to said tracking request by sampling each of said delivery stages over a data line and by:

(i) responding to receipt of a response including said code and said identification code by stripping off said identification code and by comparing said identification code to a data base for identifying said delivery stage and thereby locating said mail article; and (ii) transmitting said location to said mailer station.

57. The method of tracking an article through a multistage delivery station comprising the steps of;

placing a keyline code on each article;

placing a location suffix code onto said keyline code for entry in a data storage location at each delivery stage;

transmitting a status request to each of said delivery stages, said status request including said keyline code;

receiving a response from said delivery stage wherein said article is located, which response includes said location suffix;

stripping said suffix code off said keyline code;

comparing said location code to a database including all such codes to uniquely identify said location; and displaying said location to said user.

58. The method of claim 57, wherein said article is a mailpiece, and said keyline includes a certification that postage applied to said mailpiece is accurate.

59. The method of claim 57, further including the step of providing postage on said article for payment for delivery through said system.

60. An apparatus for performing postal functions in a multicomponent interrelated system comprising: a computer, a plurality of means for performing postal functions based on a predetermined input, a central data facility, a communication means connected to the computer for communicating with said central data facility, said central data facility including first means responsive to a signal received from said computer for providing a response signal indicative of a training request from said computer, said response signal including a set of interactive training instructions transmitted to said computer.

61. Apparatus as claimed in claim 60, wherein said set of instructions contains information for training operations in the carrying out of postal functions.

62. A communication system for processing information for distribution, comprising: a central data station having a database, a plurality of user stations, each of said user stations including a plurality of components forming a secure path for the proper distribution of said information, a communication link interconnecting said user stations with said central data station, said central data station including means for periodically interrogating a user station for determining the operational status of each of said components, means located within said central data station for indicating a request from a user station for graphic display data to be included in said information distribution by said user and derived from said central data station data base, and means responsive to said request for downloading said graphic display data to said user station from said central data station.

63. A communication system for improving the mailer-related operations of separated users having mail-processing facilities, comprising: a computerized central data station having a database containing mailer training data and advertising data, a plurality of computerized user stations each having means for storing data a communication link interconnecting said user stations with said central data station, means located within said central data station for responding to a request by one of said user stations for either training data an advertising data to be derived from said central data station database, and means responsive to said request for downloading the requested data to said user station from said central data center for use by the mail-processing facility at said user station.

64. The communication system of claim 63, wherein said downloaded data includes graphic display data.

65. An apparatus for performing postal functions in a multicomponent interrelated system comprising: a central processor, a plurality of means for performing postal functions for calculating appropriate postage based on a predetermined input, said central processor monitoring the operation of each of said components, means coupled to said central processor for monitoring compliance of each of said components with a standard for acceptability of each of said postal functions, and means for certifying the resultant product of said apparatus as being in accordance with said standards, a communication means for communicating with a central data facility, said central data facility including first means responsive to a signal received from said central processor for providing a response signal indicative of a training request from said central processor, said response signal including a set of interactive training instructions for training operators.

66. The apparatus of claim 65, wherein said training instructions includes a first set of instructions for new techniques in mailing, a second set of instructions for new rates, a third set of instructions for new types of services, and a fourth set of instructions by which a local user may take advantage of the presorting capability for additional rate discounts.

67. A central data facility for use with apparatus for performing postal functions in a multicomponent interrelated system comprising: a computer, means for connecting the computer to a communication link to a user facility carrying out mail processing functions, a data base of interactive training instructions for training operators in the carrying out of mail processing functions, means responsive to a signal received from a user facility indicative of a training request for transmitting to said user facility a set of interactive training instructions for training personnel to properly use the equipment at said facility.

68. A mail processing facility comprising a computer, apparatus for performing postal functions in a multicomponent interrelated system, means for connecting the computer to a communication link to a central facility having a data base of interactive training instructions for training operators in the carrying out of mail processing functions, means for transmitting to the central facility a request for a set of interactive training instructions, and means connected to the computer for receiving from the central facility said requested set of interactive training instructions for use in training operators in the carrying out of mail processing functions with said apparatus at said mail processing facility.

* * * * *